US006742983B2

(12) United States Patent
Schmuecker

(10) Patent No.: US 6,742,983 B2
(45) Date of Patent: Jun. 1, 2004

(54) COMPRESSOR CASING STRUCTURE

(75) Inventor: Juergen Schmuecker, Munich (DE)

(73) Assignee: MTU Aero Engines GmbH, Munich (DE)

( * ) Notice: Subject to any disclaimer, the term of this patent is extended or adjusted under 35 U.S.C. 154(b) by 85 days.

(21) Appl. No.: 10/196,552

(22) Filed: Jul. 17, 2002

(65) Prior Publication Data

US 2003/0026695 A1 Feb. 6, 2003

(30) Foreign Application Priority Data

Jul. 18, 2001 (DE) ..... 101 35 003

(51) Int. Cl.[7] ..... F04D 29/52

(52) U.S. Cl. ..... 415/1; 415/58.5; 415/57.4; 415/173.1

(58) Field of Search ..... 415/1, 58.5, 57.4, 415/173.1, 119

(56) References Cited

U.S. PATENT DOCUMENTS

| | | | |
|---|---|---|---|
| 4,466,772 A | 8/1984 | Okapuu et al. | |
| 5,282,718 A | 2/1994 | Koff et al. | |
| 6,231,301 B1 * | 5/2001 | Barnett et al. | 415/57.4 |

FOREIGN PATENT DOCUMENTS

| | | |
|---|---|---|
| DE | 3539604 | 2/1987 |
| DE | 3521798 | 8/1992 |
| EP | 0497574 | 8/1992 |
| EP | 0719908 | 7/1996 |
| EP | 1008758 | 6/2000 |
| EP | 1101947 | 5/2001 |
| WO | 94/20759 | 9/1994 |

* cited by examiner

*Primary Examiner*—Edward K. Look
*Assistant Examiner*—Kimya N McCoy
(74) *Attorney, Agent, or Firm*—Crowell & Moring LLP

(57) ABSTRACT

A compressor casing structure in the region of a rotor blade ring through which there is an axial flow, having a multiplicity of axial grooves which extend from a first radial plane upstream of the blade-tip inlet edges into a second radial plane between the blade-tip inlet edges and the blade-tip outlet edges and have groove cross sections with parallel side walls. The center axes of the groove cross sections have, at the upstream groove ends, from the opening to the groove base, an angle of inclination with a circumferential component counter to the direction of movement of the blade. The center axes of the groove cross sections have, at the downstream groove ends, an angle of inclination with a circumferential component in the direction of movement of the blade.

16 Claims, 1 Drawing Sheet

COMPRESSOR CASING STRUCTURE

This application claims the priority of German Patent Document No. 101 35 003.1, filed Jul. 18, 2001, the disclosure of which is expressly incorporated by reference herein.

BACKGROUND AND SUMMARY OF THE INVENTION

The invention relates to a compressor casing structure in the region of a rotor blade ring through which there is an axial flow, having a multiplicity of grooves which are distributed uniformly over the circumference of the casing, are open towards the blade tips and extend at least approximately axially.

A compressor casing structure of this type is known, for example, from German Patent Document No. DE 35 21 798 C2 and primarily has the function of raising the pumping limit when there is increasing throttling in the partial load mode or full load mode in order to permit reliable operation without pumping or in order to permit the available operating range to be increased. The grooves act here as recirculation channels for built-up air under high pressure, which would lead to rotating stall and pumping in the outer region of the rotor blade ring without a recirculation facility. Here, the upstream, front groove ends are located upstream of the blade-tip inlet edges (see dimension A in FIGS. 2, 8, 9 and 10), the rear groove ends lie in the radial plane of the blade-tip outlet edges or just before this radial plane. According to FIG. 4 of this patent document there is provision for the grooves which are straight per se to be arranged inclined in the circumferential direction in such a way that the ingress of air is facilitated at their downstream ends (see also claim 2 in this respect).

A further measure in order to improve the ingress of air is to position the grooves/slits obliquely at an angle with respect to the compressor longitudinal center axis (see FIG. 3 and claim 3).

European Patent Document No. EP 0 497 574 B1 protects a compressor casing structure (fan case treatment), which is arranged over the blade tips of a low-pressure compressor. This structure comprises inlet and outlet passages (34, 36) or inlet and outlet openings (56, 58) which are spaced apart axially and vanes (38, 66) in the connecting passages between the inlet and outlet. The recirculation air which enters the structure with a significant circumferential component is deflected by the vanes in such a way that it is fed back into the main stream through the outlet in a predominantly axial direction, i.e., largely without a circumferential component. Without this change or reduction in the circumferential component, the air would strike the rotor blade tips with a swirl opposed to the rotation of the blade tips, i.e., with a significant angular deviation from the blade entrance angle at the pressure side, associated with flow losses and an increased tendency towards hydraulic stalling on the suction side. This disadvantage, which still occurs in certain embodiments of DE 35 21 798 C2, is avoided according to EP 0 497 574 B1. However, the structural complexity with separate inlet and outlet openings as well as a multiplicity of vanes is very high and can certainly only be implemented with geometrically large compressor blades and casings.

In view of the above, the object of the present invention is to make available a compressor casing structure which is based on the principle of the circulation of air and gas and which permits the pumping limit of a compressor to be raised significantly, thus making possible a perceptible increase in its working range through hydraulic optimization, with a simple, cost-effective design.

The present invention uses grooves which are open towards the rotor blade tips and whose openings extend at least approximately axially in the outer annular space contour. In contrast to known solutions, the groove cross sections are however continuously swirled from the upstream groove ends as far as the downstream groove ends, i.e., their angle of inclination with the radial component and circumferential component changes uninterruptedly over the length of the groove, there being a point with a purely radial cross sectional orientation approximately in the axial center of the groove, that is to say a "zero cross-over" of the angle of inclination. The groove cross sections are inclined at the downstream groove ends in such a way that the entry of the recirculation air is made easier, the inclination from the opening to the groove base having a circumferential component in the direction of rotation, i.e., in the direction of movement of the blade tips. At the upstream groove ends, the inclination is reversed so that the recirculation air which emerges here into the main stream strikes the rotating rotor blade tips in a co-rotating fashion, which significantly improves the application of the flow and reduces losses. The tendency towards breaking away of the flow is also markedly reduced.

Other objects, advantages and novel features of the present invention will become apparent from the following detailed description of the invention when considered in conjunction with the accompanying drawings.

BRIEF DESCRIPTION OF THE DRAWINGS

The present invention is then also explained in more detail with reference to the drawings. Here, in simplified views which are not to scale.

DETAILED DESCRIPTION OF THE DRAWINGS

Figure 1:
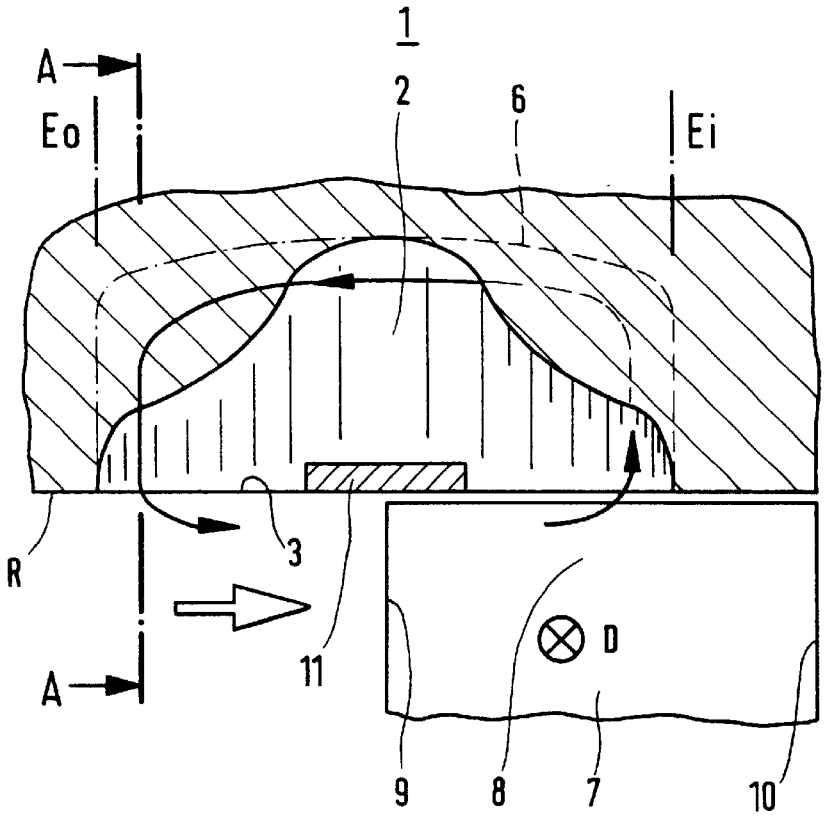
FIG. 1 shows an axial-radial partial longitudinal section through a compressor casing structure in the region of a rotor blade tip.

The compressor casing structure 1 has a multiplicity of grooves 2 which are distributed uniformly over the casing circumference and which extend from an upstream radial plane Eo as far as a downstream radial plane Ei. In the right-hand, lower part of FIG. 1, the tip 8 of a blade of a rotor blade ring 7 is shown, the blade-tip inlet edge 9 being on the left in accordance with the direction of flow (large white arrow), and the blade-tip outlet edge 10 being on the right. The direction D of movement of the blade tip 8 is indicated by a cross in a circle; the circumferential component of the corresponding direction of rotation should therefore point towards the rear starting from the plane of the drawing. The radial plane Eo, i.e., the front groove end, is located significantly upstream of the blade-tip inlet edge 9, and the radial plane Ei, i.e., the rear groove end, lies axially between the blade-tip inlet edge 9 and the blade-tip outlet edge 10, the precise position depending on the expected flow conditions (compression surge, etc.). The flow recirculation through the groove 2 is characterized by small white arrows. Each groove 2 is continuously swirled (twisted) according to the invention from its front upstream end to its rear downstream end, the swirl axis being a virtual axial straight line in the annular space contour R. The annular space contour R will generally be circular-cylindrical in the groove region, and in rare cases it can slightly taper or widen in the manner of a circular cone. The opening 3 of each groove thus has an at least largely axial center line/axis of symmetry. The striking, mirror-symmetrical and bell-like sectional line in FIG. 1 is obtained by a radial-axial plane making a section through the spatially swirled groove contour. The dashed groove contour, in particular the groove base 6 to the right above the "bell line", is located behind the plane of the drawing, while the dot-dashed groove contour to the left above the "bell line" is located in front of the plane of the drawing. At the highest point of the "bell line", the center of the groove base 6 is located precisely in the plane of the drawing, as is the virtual center axis of the corresponding groove cross section. The opening 3 of each groove 2 can be covered in its axially central region by an annular circumferential web 11 whose internal diameter is aligned with the annular space contour R. As a result, advantages can be obtained in terms of less friction, turbulence, etc.

Figure 2:
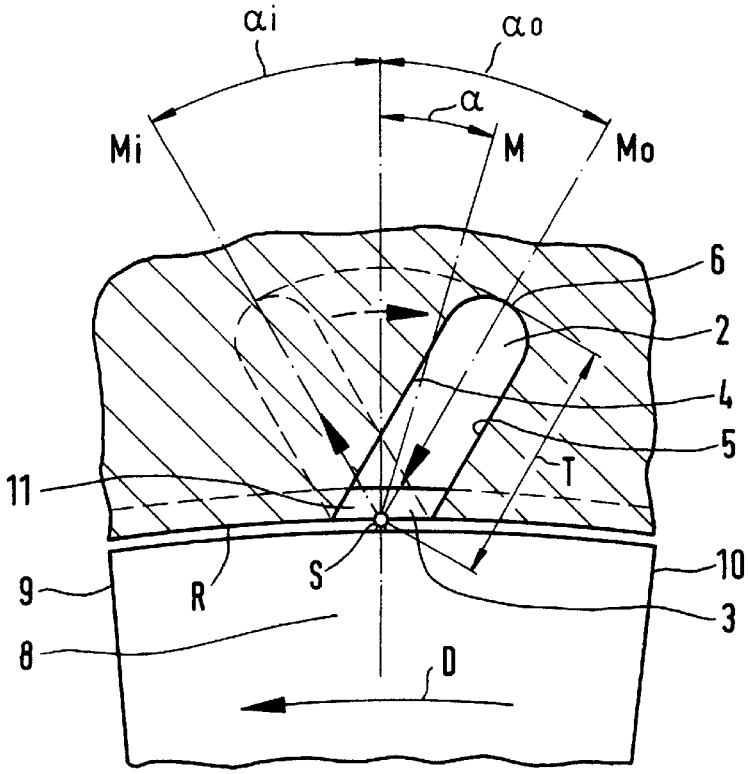
FIG. 2 shows a partial cross section according to the sectional line A—A in FIG. 1.

The invention becomes easier to understand if FIG. 2 is considered in conjunction with FIG. 1. FIG. 2 corresponds to a radial section/cross section along the line A—A in FIG. 1. In the lower part of FIG. 2 it is possible to see the blade tip 8 with its direction D of movement (arrow to the left) and with its inlet edge 9 and its outlet edge 10. At a small distance above the blade-tip contour it is possible to see the annular space contour R as a circular arc line. The vertical, dot-dashed axis (not designated in more detail) through the point S corresponds to the radial direction, starting from the center of the rotor blade ring. The axes M, Mi and Mo which are inclined to the side correspond to virtual center axes of the groove cross sections at axially different points on the length of the groove. Through the sectional profile, the frontmost groove cross section which is located furthest upstream opens with the center line Mo at an angle of inclination $\alpha o$. It is possible to see, inter alia, the parallel side walls 4, 5 of the groove 2 and the semicircular groove base 6. The center axis Mo intersects the annular space contour R at the point S, the distance between the point S and the center of the groove base 6 being designated as groove depth T. The groove cross section which is furthest downstream, with the center axis Mi and the angle of inclination $\alpha i$ is represented by dashed lines for the most part because it is largely concealed behind the plane of the drawing. As the groove depth T is intended to be constant here over the axial extent of the groove, all the centers of the groove base lie on a dashed arc. The center axes M, Mi, Mo of all the groove cross sections intersect the annular space contour on an axial straight line at different angles of inclination $\alpha$, $\alpha i$, $\alpha o$ so that S is not only a point of intersection but also a straight axial sectional line and at the same time the axis of symmetry of the opening 3 of the groove 2. S is thus also the virtual center of the swirl/twisting. The path of the recirculation flow through the groove 2 is also indicated here with small white arrows. The flow enters the rear end of the groove approximately at the angle $\alpha i$ with a circumferential component in the direction of movement of the blade tips 8. The flow leaves the front end of the groove approximately at the angle $\alpha o$ in a co-rotation with the rotation of the blade. In this way, the entry of the flow into the groove 2 and the application of the flow to the blade tips after leaving the groove are improved, permitting the overall efficiency to be significantly increased.

The letters "i" and "o" in conjunction with "M" and "$\alpha$" are intended to represent "in" and "out" as an indication of the entering and exiting of the recirculation flow.

The groove depth can vary over the axial extent of the groove, it being possible in particular to reduce the depth towards the two groove ends. The precise definition of the groove geometries including the angles of inclination is expected to require corresponding calculations and trials.

For the sake of clarity only one groove 2 is illustrated in FIG. 2. The grooves are actually relatively close to one another in the circumferential direction, and the remaining wall thicknesses between the grooves can be smaller than the clearance between the side walls of the grooves. In reality, FIG. 2 would then have to show approximately 4 to 5 grooves one next to the other.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A compressor casing structure in a region of a rotor blade ring through which there is an axial flow, comprising a multiplicity of grooves which are distributed uniformly over a circumference of the casing, are open towards blade tips of the rotor blade ring, run at least approximately axially, extend axially from a first radial plane upstream of blade-tip inlet edges into a second radial plane between the blade-tip inlet edges and blade-tip outlet edges and have, in each case in the radial section, groove cross sections with side walls which are straight and parallel over a large part of their depth, wherein the center axes of the groove cross sections have at upstream groove ends, from an opening to a groove base, an angle of inclination with respect to a radial direction with a circumferential component counter to a direction of movement of the blade tips, and wherein the center axes of the groove cross sections have at downstream groove ends, from the opening to the groove base, an angle of inclination with respect to the radial direction with a circumferential component in the direction of movement of the blade tips, wherein the angle of inclination of the center axes of the groove cross sections changes continuously in a swirling twisting manner between the upstream and the downstream groove ends, and wherein sectional lines of the center axes of the groove cross sections with an outer casing-end annular space contour are at least approximately axial straight elements so that the openings of the grooves extend axially in the same way.

2. The compressor casing structure according to claim 1, further comprising an annular web which partially closes off the openings of the grooves wherein the web is arranged in an axially central region of the grooves and an inner diameter of the web corresponds to a local diameter of the outer annular space contour.

3. The compressor casing structure according to claim 1, wherein the grooves are fabricated in a metal-cutting fashion by means of milling, in particular by means of end-milling or spherical cutters, or in non-metal-cutting fashion by casting or spark erosion.

4. The compressor casing structure according to claim 1, wherein each groove base is rounded or at least a junction between the side walls and the groove base is rounded.

5. The compressor casing structure according to claim 1, wherein an average surface roughness Ra in the grooves is 1.6 $\mu$m.

6. The compressor casing structure according to claim 1, wherein boundaries of the openings of the grooves, i.e., junctions between the outer annular space contour, are embodied with sharp edges.

7. The compressor casing structure according to claim 1, wherein a groove depth is constant over an axial groove length or reduces continuously from an axially central groove region to the upstream groove end and to the downstream groove end, in each case calculated from the sectional line of the center axes of the groove cross sections with the outer annular space contour up to a center of the groove base.

8. A compressor casing structure in a region of a rotor blade ring having blades, comprising:

a plurality of grooves distributed uniformly over a circumference of the casing, wherein each groove has an opening, a base, and a center axis;

wherein the center axis of one of the grooves at an upstream groove end has an angle of inclination counter to a direction of movement of a tip of the blades; and wherein the center axis of the one of the grooves at a downstream groove end has an angle of inclination in the direction of movement of the tip of the blades.

9. The compressor casing structure of claim 8, wherein the angle of inclination of the one of the grooves changes continuously between the upstream groove end and the downstream groove end.

10. The compressor casing structure of claim 9, wherein the angle of inclination changes continuously in a twisting manner.

11. The compressor casing structure of claim 8, wherein a center of the groove opening of the one of the grooves is positioned in a same location around the circumference of the casing from the upstream groove end to the downstream groove end.

12. The compressor casing structure of claim 8 further comprising an annular web which partially closes off the opening of the one of the grooves.

13. The compressor casing structure of claim 8, wherein the one of the grooves has a groove depth that is constant over an axial groove length.

14. A method for recirculating air in a compressor casing structure, comprising the steps of:

flowing air at a downstream location in a flow channel in the compressor casing structure into a groove;

flowing the air in the groove from the downstream location to an upstream location; and flowing the air out of the groove into the flow channel at an upstream location;

wherein the groove has an angle of inclination at a downstream groove end in a direction of movement of a tip of a blade housed in the compressor casing structure and wherein the groove has an angle of inclination at an upstream groove end counter to the direction of movement.

15. The method of claim 14, wherein the angle of inclination of the groove changes continuously between the upstream groove end and the downstream groove end.

16. The method of claim 15, wherein the angle of inclination changes continuously in a twisting manner.

* * * * *